US011482809B2

(12) United States Patent
Zebhauser

(10) Patent No.: US 11,482,809 B2
(45) Date of Patent: Oct. 25, 2022

(54) MODULAR PLUG CONNECTOR SYSTEM

(71) Applicant: Rosenberger Hochfrequenztechnik GmbH & Co. KG, Fridolfing (DE)

(72) Inventor: Martin Zebhauser, Laufen (DE)

(73) Assignee: Rosenburger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 16/972,387

(22) PCT Filed: May 21, 2019

(86) PCT No.: PCT/EP2019/063098
§ 371 (c)(1),
(2) Date: Dec. 4, 2020

(87) PCT Pub. No.: WO2019/233762
PCT Pub. Date: Dec. 12, 2019

(65) Prior Publication Data

US 2021/0234304 A1 Jul. 29, 2021

(30) Foreign Application Priority Data

Jun. 5, 2018 (DE) ..... 10 2018 113 365.0

(51) Int. Cl.
*H01R 13/502* (2006.01)
*H01R 13/627* (2006.01)
(Continued)

(52) U.S. Cl.
CPC ..... *H01R 13/6272* (2013.01); *H01R 13/4362* (2013.01); *H01R 13/514* (2013.01);
(Continued)

(58) Field of Classification Search
CPC ..... H01R 13/6272; H01R 13/4362; H01R 13/514; H01R 13/654; H01R 31/06; H01R 2201/26
See application file for complete search history.

(56) References Cited

U.S. PATENT DOCUMENTS 4,764,129 A * 8/1988 Jones ..... H01R 13/642 439/680
4,852,963 A * 8/1989 Lampert ..... G02B 6/3887 385/60
(Continued)

FOREIGN PATENT DOCUMENTS

CN 101861682 A 10/2010
DE 20 2012 007 577 U1 11/2012
(Continued)

*Primary Examiner* — Thanh Tam T Le
(74) *Attorney, Agent, or Firm* — Donald S. Showalter, Esq.; GrayRobinson, P.A.

(57) ABSTRACT

Embodiments of a modular plug connector system for vehicles may include a module housing having a first housing part with a plurality of uniform first plug places having interfaces for receiving a respective first adapter from a first adapter group, wherein the first adapter group has a plurality of first adapters of different types which have, on their outer sides, uniform interfaces for positioning in the first plug places of the first housing part, wherein the adapters have a different internal geometry for accommodating differently designed plug connectors. The module housing also has a second housing part with a plurality of uniform second plug places having interfaces for receiving a respective second adapter from a second adapter group, wherein the second adapter group has a plurality of second adapters of different types which have, on their outer sides, uniform interfaces for positioning in the second plug places of the second housing part, wherein the adapters have a different internal geometry for accommodating differently
(Continued)

designed mating connectors. The outer sides of the first adapter and the second adapter and their corresponding plug places are may form a primary safety device for securing the adapters in their respective plug places when the corresponding adapter is inserted into an end position in the plug places.

26 Claims, 6 Drawing Sheets

(51) Int. Cl.
*H01R 13/436* (2006.01)
*H01R 13/514* (2006.01)
*H01R 13/645* (2006.01)
*H01R 31/06* (2006.01)

(52) U.S. Cl.
CPC ..... *H01R 13/645* (2013.01); *H01R 31/06* (2013.01); *H01R 2201/26* (2013.01)

(56) References Cited

U.S. PATENT DOCUMENTS 4,915,641 A * 4/1990 Miskin ..... H01R 13/631 439/247
4,997,386 A * 3/1991 Kawachi ..... H01R 13/514 439/352
5,123,071 A * 6/1992 Mulholland ..... G02B 6/3875 385/53
5,274,729 A * 12/1993 King ..... G02B 6/264 385/134
5,342,221 A * 8/1994 Peterson ..... H01R 13/514 439/877
5,595,509 A * 1/1997 Fry ..... H01R 13/4362 439/595
5,647,043 A * 7/1997 Anderson ..... G02B 6/3893 385/78
6,102,581 A * 8/2000 Deveau ..... G02B 6/266 385/139
6,149,315 A * 11/2000 Stephenson ..... G02B 6/266 385/60
6,443,627 B1 * 9/2002 Anderson ..... G02B 6/3825 385/56
7,094,109 B2 * 8/2006 Chou ..... H01R 12/00 439/651
7,223,131 B2 * 5/2007 Moll ..... H01R 13/506 439/752
7,258,493 B2 * 8/2007 Milette ..... G02B 6/3831 439/680
7,347,745 B1 * 3/2008 Raudenbush ..... H01R 24/40 439/752
7,674,046 B2 * 3/2010 Milette ..... G02B 6/3831 385/75
7,682,205 B2 3/2010 Hall et al.
8,807,843 B2 * 8/2014 Gurreri ..... G02B 6/3831 439/680
8,888,522 B2 * 11/2014 Schrader ..... H01R 13/645 439/353
9,379,492 B2 6/2016 Zebhauser et al.
9,608,374 B2 3/2017 Beischer et al.
9,722,348 B2 8/2017 Zebhauser et al.
9,882,317 B1 * 1/2018 Lane ..... H01R 24/20
10,177,480 B2 * 1/2019 Choi ..... H01R 13/213
10,234,635 B1 * 3/2019 Fabian ..... H01R 13/5221
10,601,153 B2 * 3/2020 Maki ..... H01R 9/0503
10,720,718 B2 * 7/2020 Kimura ..... H01R 13/6591

FOREIGN PATENT DOCUMENTS

DE 20 2013 006 295 U1 10/2013
DE 10 2013 106 279 A1 12/2014
DE 20 2016 104 271 U1 10/2016
EP 1 020 959 A2 7/2000

* cited by examiner

MODULAR PLUG CONNECTOR SYSTEM

CROSS REFERENCE TO RELATED APPLICATIONS

This is a U.S. National Phase Entry under 35 U.S.C. § 371 of International Application No. PCT/EP2019/063098 filed May 21, 2019 entitled: MODULAR PLUG CONNECTOR SYSTEM which designates the United States and at least one other country in addition to the United States and claims priority to German Patent Application No. 10 2018 113 365.0 filed Jun. 5, 2018.

STATEMENT REGARDING FEDERALLY-SPONSORED RESEARCH OR DEVELOPMENT

Not applicable.

INCORPORATION BY REFERENCE

International Application No. PCT/EP2019/063098 and German Patent Application No. 10 2018 113 365.0 are each expressly incorporated herein by reference in their entireties to form part of the present disclosure.

FIELD OF INVENTION

The invention relates to a modular plug connector system for vehicles and to a module housing for a modular plug connector system. A further aspect of the invention relates to a secondary securing means for securing adapters in respective plug places of a modular plug connector system.

BACKGROUND

The fabrication of cables typically involves the conductors thereof being connected to a plug connector in order then, in a known manner, to be able to establish electrical connections with other cables or conductors which have corresponding mating plug connectors. A plug connector or mating plug connector may be a plug, a panel plug, a socket, a coupling or an adapter. The designation "plug connector" used in the context of the invention represents all variants.

Particularly plug connectors for the automotive industry or for vehicles have high demands placed on them in terms of their robustness and the security of the plug connections. A plug connection is thus at times required to withstand high loading, for example mechanical loading, and to remain closed in a defined manner such that the electrical connection is not unintentionally disconnected, for example during the operation of a vehicle. Guaranteeing the security is paramount particularly during the autonomous operation of vehicles and for assistance systems.

Furthermore, the number of plug connections to be installed in vehicles is constantly increasing, while the required plug connector systems are becoming ever more complex at the same time. What frequently occurs in practice is that different types of plug connectors are integrated in a common module housing. A particular problem is that the assembly of the different plug connector types to be integrated in a module housing can greatly vary in an application-specific manner, for example in dependence on the vehicle type. The personnel and economic outlay on design, production and assembly of the plug connector systems is therefore comparatively high, particularly for vehicles.

The object on which the present invention is based is that of providing an improved plug connector system for vehicles that is suitable for the integration of different plug connector types in a common module housing.

Finally, the object on which the invention is based is also that of providing a module housing in which different plug connector types can be integrated, while avoiding the disadvantages of the prior art.

The object on which the invention is based is additionally that of providing a secondary securing means for a plug connector system.

BRIEF SUMMARY OF THE INVENTION

The modular plug connector system according to the invention for vehicles comprises a module housing having a first housing part having a plurality of uniform plug places with interfaces for respectively receiving a first adapter from a first adapter group, wherein the first adapter group comprises a plurality of first adapters of different type which have uniform interfaces on their outer sides for positioning in the plug places of the first housing part, and which have a different internal geometry for receiving differently configured plug connectors and/or which are formed in one piece with differently configured plug connectors. The outer sides of the first adapters and the plug places of the first housing part are configured in such a way that they form a primary securing means for fastening the first adapter in the respective plug place when the first adapter is inserted into an end position in the plug place. According to the invention, the module housing further comprises a second housing part having a plurality of uniform plug places with interfaces for respectively receiving a second adapter from a second adapter group, wherein the second adapter group comprises a plurality of second adapters of different type which have uniform interfaces on their outer sides for positioning in the plug places of the second housing part, and which have a different internal geometry for receiving differently configured mating plug connectors and/or which are formed in one piece with differently configured mating connectors. The outer sides of the second adapters and the plug places of the second housing part are configured in such a way that they form a primary securing means for fastening the second adapter in the respective plug place when the second adapter is inserted into an end position in the plug place.

The modular plug connector system described is advantageously suitable for use in a vehicle since the requirements—in particular with regard to weight, size and number of different plug connector types to be used—in a vehicle are particularly high.

In the present case, the term "vehicle" describes any means of locomotion, in particular land vehicles, watercraft or aircraft, also including spacecraft. However, the invention is very particularly suitable for use in motor vehicles.

For the purposes of the invention, a "uniform plug place" is to be understood in particular as meaning a functionally uniform plug place which can be used for the universal reception of the adapter types provided in the corresponding adapter group. For this purpose, the geometrical and, where appropriate, electrical configuration of the different plug places does not necessarily have to be completely identical; however, this is preferably the case.

The plug places preferably take the form of chambers.

The adapters serve to make usable any desired types of plug connectors or mating plug connectors for the modular plug connector system. For this purpose, the plug connectors or mating plug connectors can be plugged into an adapter of a suitable type.

The modular plug connector system can comprise the first adapters and the second adapters.

The modular plug connector system can additionally comprise the plug connectors and the mating plug connectors.

A plug connector or mating plug connector can also be an individual (or a plurality of) fabricated contact(s).

It is a particular advantage of the invention that a plug connector system for vehicles can now be used in a modular manner, thereby making it possible to considerably simplify the plug connector system in terms of the design effort, production outlay and assembly effort. For example, there can be provision to use the plug connector system according to the invention across vehicle models. Here, the module housing can always be the same. During assembly, it may be merely required to select the correspondingly suited adapters from a prepared number of adapters for receiving the plug connectors or mating plug connectors and to virtually freely combine them in the module housing using any desired plug places.

The plug places can take the form of cavities or chambers which have a functionally identical geometrical configuration in order to receive the different types of adapters, which, however, have uniform interfaces for positioning, in particular for fastening.

Preferably, all the plug places for the first adapter group are of identical design. Preferably, all the plug places for the second adapter group are of identical design. Preferably, the plug places for the first adapter group and the plug places for the second adapter group are not of identical design.

It is particularly preferable for all the plug places of the first housing part to be of identical design. It is particularly preferable for all the plug places of the second housing part to be of identical design. Preferably, the plug places of the first housing part and the plug places of the second housing part are not of identical design.

There can be provision that an adapter and hence plug connector or mating plug connector of any desired type of the first or second adapter group can be plugged into each plug place by virtue of the adapters being configured with a functionally identical external geometry and having an internal geometry which is designed for receiving the respective plug connector or mating plug connector.

A modular system of different adapters for integrating any desired plug connectors or mating plug connectors into the plug connector system can be provided.

The first adapters have, according to the invention, uniform interfaces on their outer sides for positioning, in particular for fastening and/or for inserting into the plug places of the first housing part. Interfaces for positioning which apply are in particular interfaces for fastening, for inserting, for low-play positioning or orienting in the end position and for receiving a uniform secondary securing means. The adapters are preferably configured in such a way that they form at least one, preferably a plurality of, particularly preferably all, interface(s) stated below. There is preferably provided an interface for forming the primary securing means, an interface for receiving a secondary securing means, an interface for inserting/guiding the adapter to position it in the plug place, an interface which is suitable to form an end stop with the plug place, and an interface to realize as low-play positioning as possible in the end position (assembly position) in the plug place, wherein, for low-play positioning, preferably the external geometry of the first adapter is correspondingly configured.

The second adapter preferably has an analogous design of its interfaces with the plug places of the second housing part.

The primary securing means according to the invention can in particular be a force-fitting and/or form-fitting means of securing the first or the second adapter in the housing part.

The primary securing means is preferably designed as a form-fitting axial securing means in order to prevent extraction of the adapters counter to the plug-in direction when the adapters are inserted into their end position There can be provision for the primary securing means to be released again as required, for example with the aid of a suitable means, for example a screwdriver. However, there can also be provision that the primary securing means can no longer be opened non-destructively after the corresponding adapter has been inserted into its end position.

As an alternative to the first adapter group having a plurality of first adapters which have a different internal geometry for receiving differently configured plug connectors, there can also be provision for a plurality of first adapters to be formed in one piece with differently configured plug connectors.

Alternatively or additionally, there can analogously also be provision for a plurality of second adapters to be formed in one piece with differently configured plug connectors.

A one-piece formation of the adapters with a plug connector or a mating plug connector can be achieved for example in that the adapter is manufactured from plastic and is for example formed in one piece with the plastic of the plug connector or of the mating plug connector.

A one-piece configuration of the plug connector or the mating plug connector with the respective adapter leads in a simple manner to the plug connector or the mating plug connector having interfaces which make it possible to fix them in one of the uniform plug places of the assigned housing part.

In principle, mixed forms are also possible, that is to say one subgroup of the first adapters can have an internal geometry for receiving plug connectors, whereas another subgroup of the first adapters is formed in one piece with, in this case, at least one plug connector. There can be provision for at least two first adapters to be formed in one piece with plug connectors which are configured differently from one another. Corresponding mixed forms can be provided analogously for the second adapters too.

Furthermore, it is possible in principle that, for example, the first adapters each have a suitable internal geometry such that the first adapter group can receive at least two differently configured plug connectors, whereas the second adapters of the second adapter group are formed in one piece with at least two differently configured mating plug connectors; and vice versa.

The fact that the first adapter group comprises a plurality of first adapters of different type does not mean in all alternatives that each of the first adapters is differently configured. It is sufficient within the scope of the invention if at least two of the first adapters of the first group are configured to be different from one another, that is to say at least two different types of plug connectors can be received by, and/or formed in one piece with, the first adapters of the first adapter group. The same also applies to the second adapters of the second adapter group.

An embodiment which is preferred within the scope of the invention is one in which the first adapters and the assigned plug connectors are formed as separate components and can be connected to one another, preferably by being plugged one inside the other. The same also applies to the formation of the second adapters and of the assigned mating plug connectors.

In one embodiment of the invention, there can be provision that the first housing part can be connected to the second housing part in order to connect the plug connectors received in the first housing part to the corresponding mating plug connectors received in the second housing part.

The connection of the housing parts for connecting the plug connectors to the mating plug connectors can be advantageous since then, during assembly, it is not necessary for each connection between plug connector and mating plug connector to be established individually. This can be particularly advantageous when many plug connections are present within the plug connector system.

There can be provision here in particular for an electrical connection between the plug connectors and the corresponding mating plug connectors in order to provide a suitable signal transmission. A mechanical connection between the plug connectors and the corresponding mating plug connectors, for example using their usual connecting and/or latching means, can also be advantageous.

In principle, when there is a connection between the plug connectors and the corresponding mating plug connectors, there can also be provision for the first adapters in which the plug connectors are received and for the second adapters in which the mating plug connectors are received to be electrically and/or mechanically connected to one another in order to establish an indirect electrical and/or mechanical connection between the plug connectors and mating plug connectors.

In principle, it is noted that a "first housing part" and a "second housing part" can be understood to mean two separate housing parts as well as a purely functional division of the module housing. The housing parts can therefore thus be also fixedly connected to one another or even formed in one piece.

However, the multipart design of the module housing can be particularly advantageous, whereby the first housing part can be connected to the second housing part.

In one embodiment, there can be provision in particular for the housing parts to be designed to securely channel away mechanical loads which act on the plug connectors and mating plug connectors and/or to ensure the holding force between the plug connectors and the mating plug connectors.

In particular, the housing parts can be designed in such a way as to be able to take up undesired shear forces and/or tensile forces. This has the advantage that the adapters and/or the plug connectors or mating plug connectors themselves do not necessarily have to be configured to withstand such mechanical loads. It is thus possible for the known plug connectors or mating plug connectors to have, where appropriate, a more material-saving design and, moreover, types of plug connectors or mating plug connectors can be used which typically are unsuitable for use in vehicles owing to a lack of robustness.

In one embodiment of the invention, there can be provision that the housing parts can be plugged one inside the other and can be latched with one another via at least one latching element pair.

Alternatively or additionally, however, there can also be provision that latching between the housing parts is achieved by corresponding latching means of the adapters and/or by latching means between the plug connectors and mating plug connectors.

Also possible is force-fitting securing of the housing parts plugged one inside the other, for example by corresponding formation of the housing parts, adapters and/or plug connectors or mating plug connectors.

There can also be provision for the housing parts to be mechanically coded and/or polarized such that only housing parts of the same module housing type can be plugged together and/or can be plugged in only in a defined orientation.

In one embodiment, there can be provision for the plug connectors and the mating plug connectors to be designed as plugs, couplings, sockets, printed circuit board plug connectors and/or housing plug connectors, in particular of the HFM, H-MTD, AMEC, PL, BNC, TNC, SMBA, SMA, SMB, SMS, SMC, SMP, BMS, HSD, BMK, Mini-Coax and/or Makax type.

This list is of course not limiting. In principle, the invention is suitable for the integration of any desired plug connector types or mating plug connector types in the module housing within the context of a plug connector system for vehicles. In particular, the invention is suitable for plug connectors typically used in the automotive industry, and in particular also for plug connectors for high-frequency technology.

In one embodiment of the invention, there can additionally be provision for the housing parts each to have one, two or more rows of plug places arranged parallel to or offset from one another.

Particularly if the housing parts have more than two rows of plug places, for example three rows, an offset arrangement can be advantageous in order to ensure accessibility to the individual plug places from an upper side and/or an underside of the module housing, for example to plug in the secondary securing means described further below, to ensure access to the individual primary securing means and/or to provide a viewing opening for an optical visual inspection of the plug connection.

In one embodiment of the invention, there can be provision in particular that the plug places and the adapters form a guide for guiding the adapters into the plug places.

The guide can preferably be formed by the plug places having guide webs which, in combination with corresponding guide elements, for example grooves or further guide webs of the adapters, form a rail system or some other positive guide for the plug-in movement. Alternatively, the adapters can also have guide webs and the plug places can correspondingly have correspondingly formed guide elements, for example grooves.

The plug-in movement can be particularly comfortable as a result. It is possible in particular to avoid jamming of, and, resulting therefrom, possible damage to, the components during plugging-in.

There can also be provision for one or more plug places to be to receive a plurality of adapters and hence plug connectors or mating plug connectors. The plug place or places can have correspondingly formed guide webs and/or rail systems in order, where appropriate, only selectively to receive a plurality of adapters.

In one embodiment, there can additionally be provision for the plug places to have an axial end stop.

The end stop can be provided on the inner side of the plug place or on the outer side of the plug place and correspondingly interact with the corresponding adapter. There can also be provision for the adapter to have an end stop which, with an adapter plugged into its end position, butts against the outer side of the corresponding housing part or against some other point of the corresponding housing part provided therefor.

The end stop can preferably be arranged on an end of a guide web or on an end of the rail system of the plug place.

In an advantageous embodiment of the invention, there can be provision for the primary securing means to be formed by at least one latching nose and a spring arm.

In principle, there can be provided any desired latching means which comprise one or more latching noses, spring arms, snap hooks, snap receptacles, latching hooks, etc.

The corresponding adapter can, as required, preferably be able to be removed non-destructively again from the module housing.

In one embodiment, there can additionally be provision for the adapters and the plug places to be configured in such a way that plugging-in of the adapters is possible in only one predetermined orientation.

The adapters and the plug places can have a polarization in order for example to block an adapter being plugged into a plug place by being rotated through 180° or otherwise rotated. For this purpose, the adapters and/or plug places can be correspondingly mechanically or geometrically configured, for example using asymmetrical structures, in particular chamfers or bevels. It is also possible for magnetic codings or anti-rotational safeguards to be provided, for example by means of a corresponding arrangement and distribution of magnetic poles of permanent magnets on the adapters and the plug places.

In one embodiment of the invention, there can also be provision for the first adapters, the second adapters and the two housing parts to be configured in such a way that the first adapters can be plugged only into the plug places of the first housing part, and the second adapters can be plugged only into the plug places of the second housing part.

For example, there can be provision that only plugs or "male plug connectors" can be plugged into the plug places of the first housing part and only couplings or "female plug connectors" can be plugged into the plug places of the second housing part. This can preferably occur by means of corresponding mechanical codings or geometrical configurations of the corresponding plug places and adapters. A magnetic coding can also be provided.

In one embodiment, there can further be provision for mechanical codings to be provided on the end sides of the adapters that are at the front in the plug-in direction and/or on a front end of a plug place of the housing part in such a way that only pairs of plug connectors and mating plug connectors which are functionally assigned to one another and/or which correspond to the same plug type can be connected.

It is thus possible in particular also for plug connectors and corresponding mating plug connectors of the same type to be connected to one another only when they are functionally assigned to one another. This makes it possible for example to avoid mixing up a control line of a right indicator of a motor vehicle with the control line of a left indicator.

Furthermore, the configuration can also achieve a situation, or support bringing about a situation, in which plug types which do not correspond to the same type cannot be connected to one another.

In one particular embodiment of the invention, there can be provision that to secure the adapters in the respective plug places there are provided secondary securing means which can preferably be plugged orthogonally to the plug-in direction of the adapters into the housing parts up and into a predefined end position.

The modular plug connector system can comprise the secondary securing means.

As mentioned at the outset, it is in particular on plug connector systems for vehicles that particularly high requirements are placed. It must also be ensured at times that, in spite of high mechanical loading, the opening of plug connections is avoided. A secondary securing means can thus be particularly advantageously suitable for holding the plug connections securely closed in each case and to observe or exceed corresponding safety guidelines for vehicles.

The secondary securing means are preferably plugged orthogonally to the plug-in direction of the adapters into the housing parts. However, it is also possible for the secondary securing means to be plugged into the housing parts at another angle relative to the plug-in direction of the adapters, for example also at an angle of up to five degrees (5°), up to ten degrees (10°), up to fifteen degrees (15°), or even up to forty five degrees (45°).

In one embodiment, there can be provision in particular for the secondary securing means to have blocking elements to block the primary securing means in its locking state.

The secondary securing means preferably secures the adapters in the respective plug places in a force-fitting and/or form-fitting manner.

For example, there can be provision for the blocking elements to take the form of domelike elevations and/or webs which block or engage behind a spring arm of the primary securing means and securely fix it in the corresponding latching nose or hold it in engagement with the latching nose in a form-fitting manner.

In one embodiment of the invention, there can additionally be provision for the secondary securing means to have plug-in preventers, wherein the plug-in preventers are designed to prevent a connection between a plug connector and its corresponding mating plug connector when the secondary securing means is plugged, but not yet plugged into the housing part up and into the predefined end position.

It is thus possible for a user-side (inadvertent) plugging together of two adapters to be blocked if, for example, a first adapter is not yet situated in a defined assembly position and/or is not yet sufficiently secured by the secondary securing means.

In one embodiment, there can be provision for the secondary securing means to be designed to secure the plug connectors in the first adapters and/or to secure the mating plug connectors in the second adapters.

In particular, there can be provision for the secondary securing means to secure or fix the plug connectors or mating plug connectors in the adapters in a force-fitting and/or form-fitting manner.

The secondary securing means can also be used to ensure that the plug connectors or mating plug connectors are correctly oriented within the adapters.

Furthermore, mechanical loads, in particular axial loads counter to the plug-in direction of the plug connectors or mating plug connectors in the adapters, can be absorbed by the secondary securing means.

In one embodiment of the invention, there can additionally be provision for the secondary securing means, the housing parts and/or the adapters to be designed in such a way that the secondary securing means can assume at least three plug states along their plug-in direction, wherein a first plug state relates to a basic position in which the secondary securing means is captively connected to the housing part but not yet to the corresponding adapter, and wherein a second plug state relates to a pre-latching position in which the secondary securing means is connected to the corresponding adapter inside the housing part, and wherein a third plug state relates to the end position in which the secondary securing means is completely plugged into the housing part, wherein the secondary securing means fixes the plug connector or the mating plug connector in the assigned adapter in the third plug state.

In a particularly advantageous manner, the secondary securing means is configured in such a way that it fixes both the adapter in the assigned housing part and the plug connector or the mating plug connector in the respective adapter.

The secondary securing means can preferably take the form of a slide.

The fact that the secondary securing means in its basic position is captively connected to the housing part means that the secondary securing means can be advantageously delivered with the module housing or plug connector system and is immediately ready for use without delay during assembly. The secondary securing means can thus also not be lost during delivery or assembly.

The secondary securing means can preferably be designed in such a way that the plug-in preventers prevent two corresponding adapters from being plugged together when the secondary securing means is situated in its second plug state, that is to say in the pre-latching position. It is already sufficient for this purpose if one of the adapters is provided with a secondary securing means which has a plug-in preventer.

According to an advantageous embodiment, a corresponding secondary securing means can be provided for each adapter type of the two adapter groups.

In particular, there can be provision for the secondary securing means to be adapted for securing the plug connector or mating plug connector inside the corresponding adapters.

The secondary securing means can have a securing clamp, a snap connection, a receptacle or a partially circular, preferably semicircular, spring element which in the end position embraces, preferably in a form-fitting manner, a plug connector or a mating plug connector inserted into the adapter. The plug connector or the mating plug connector preferably has a suitable groove, preferably an annular depression or a recess, into which the securing clamp, the snap connection, the receptacle or the spring element penetrate, preferably in a form-fitting manner.

The secondary securing means has latching elements, preferably on one or both ends of the securing clamp, of the receptacle, of the snap connection or of the spring element, which in the end position of the secondary securing means latch with the adapter, preferably penetrating or latching into latching receptacles formed therein, for example into a depression, a shoulder or a groove. This is preferably intended to result in a form-fitting engagement in the pull-out direction.

The latching elements of the secondary securing means are preferably designed as snap hooks. There can be provision for the secondary securing means to have two or more latching elements designed in such a way. It is preferable, however, that only one snap hook is provided and correspondingly one latching receptacle is formed in the adapter with which the snap hook can latch in the end position of the secondary securing means. This has proved to be particularly suitable for reliably securing the secondary securing means in the adapter but at the same time for making it possible, with simple measures, for example a corresponding tool, preferably a special tool, to release the secondary securing means from the adapter by releasing the latching element from its latching position in the adapter again.

The secondary securing means is preferably designed in such a way that it can be plugged into the end position only when the plug connector or the mating plug connector is positioned correctly, or in its end position, in the respective adapter. This can preferably be achieved in that the securing clamp is configured in such a way that it has to strike the annular depression in order to be able to embrace the plug connector or the mating plug connector.

It is advantageous if the secondary securing means in the end position is connected to the assigned housing part in a form-fitting manner and to the assigned adapter and/or the assigned plug connector/mating plug connector in a form-fitting manner in order to channel axial forces acting on the plug connectors/mating plug connectors via the secondary securing means into the assigned housing part.

This configuration makes it possible in a particularly advantageous manner for axial forces acting on the plug connectors/mating plug connectors in their plug-in/plug-out direction to be taken up by the housing parts. The connection between the plug connector and the mating plug connector is thus relieved of load.

The invention also relates to a module housing for a modular plug connector system according to the above statements.

Finally, the invention additionally relates to a secondary securing means for securing adapters in respective plug places of a modular plug connector system according to the above statements, wherein the secondary securing means can be plugged orthogonally to the plug-in direction of the adapters up and into a predefined end position.

The invention finally also relates to the use of a modular plug connector system for vehicles, preferably motor vehicles.

Features which have already been described in conjunction with the plug connector system according to the invention can of course also be advantageously implemented for the module housing, the secondary securing system and the use, and vice versa. Furthermore, advantages which have already been stated in conjunction with the plug connector system according to invention can also be understood as relating to the module housing, the secondary securing means or the use, and vice versa.

In addition, it is noted that expressions such as "comprising", "having" or "with" do not exclude any other features or steps. Furthermore, expressions "a", "an" or "the" which refer to a single number of steps or features do not exclude a plurality of features or steps, and vice versa.

An exemplary embodiment of the invention will be described in more detail below with reference to the drawing.

The figures here show a preferred exemplary embodiment in which individual features of the present invention are illustrated in combination with one another. However, the features of the exemplary embodiment can also be implemented in isolation from the other features of the exemplary embodiment and can accordingly be readily combined by a person skilled in the art to form further expedient combinations and sub-combinations.

BRIEF DESCRIPTION OF THE DRAWINGS

Functionally identical elements are provided with the same reference signs in the figures, in which.

DETAILED DESCRIPTION OF PREFERRED EMBODIMENTS

Figure 1:
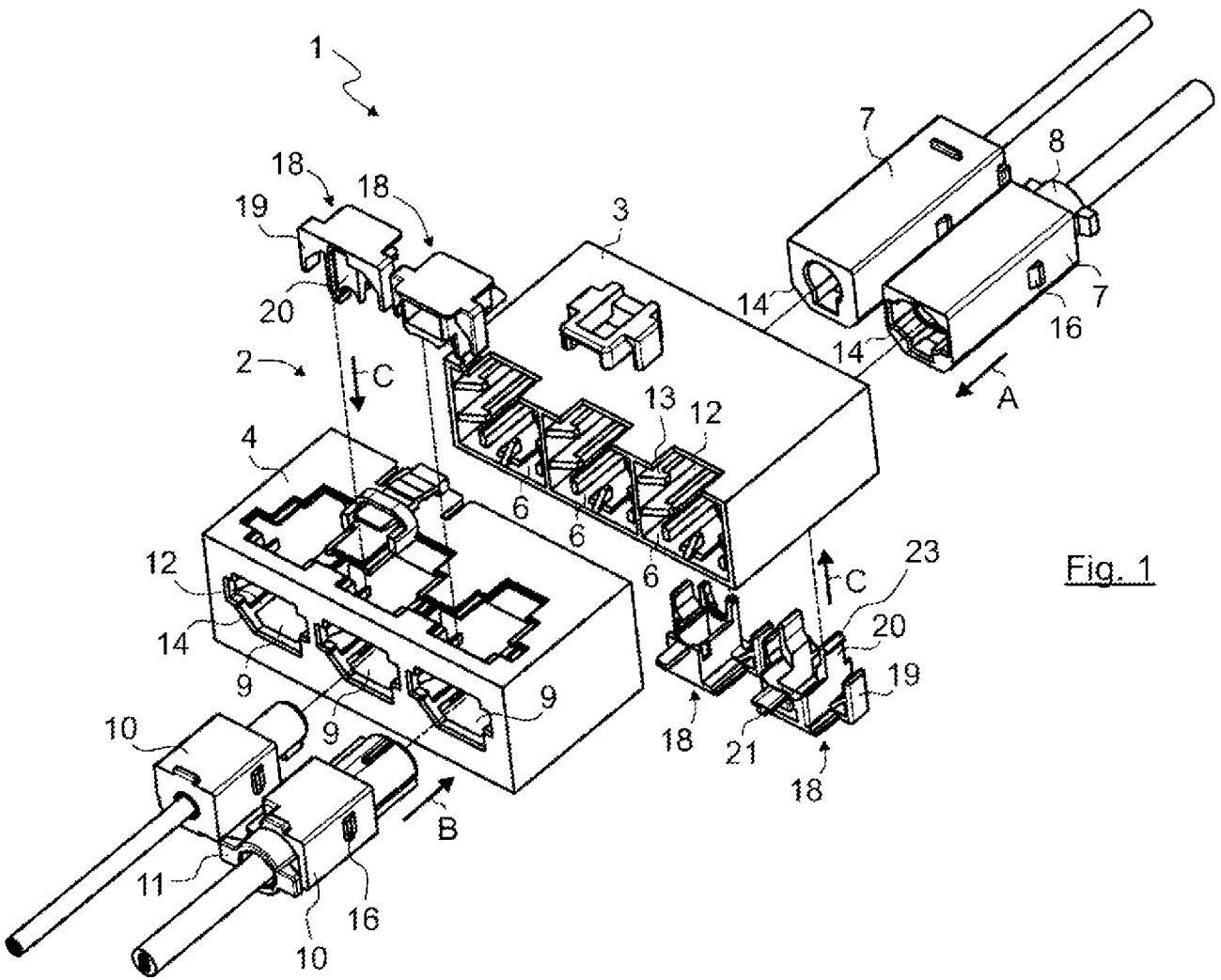
FIG. 1 schematically shows the modular plug connector system in the unassembled state in the manner of an exploded illustration in isometric view.
Figure 2:
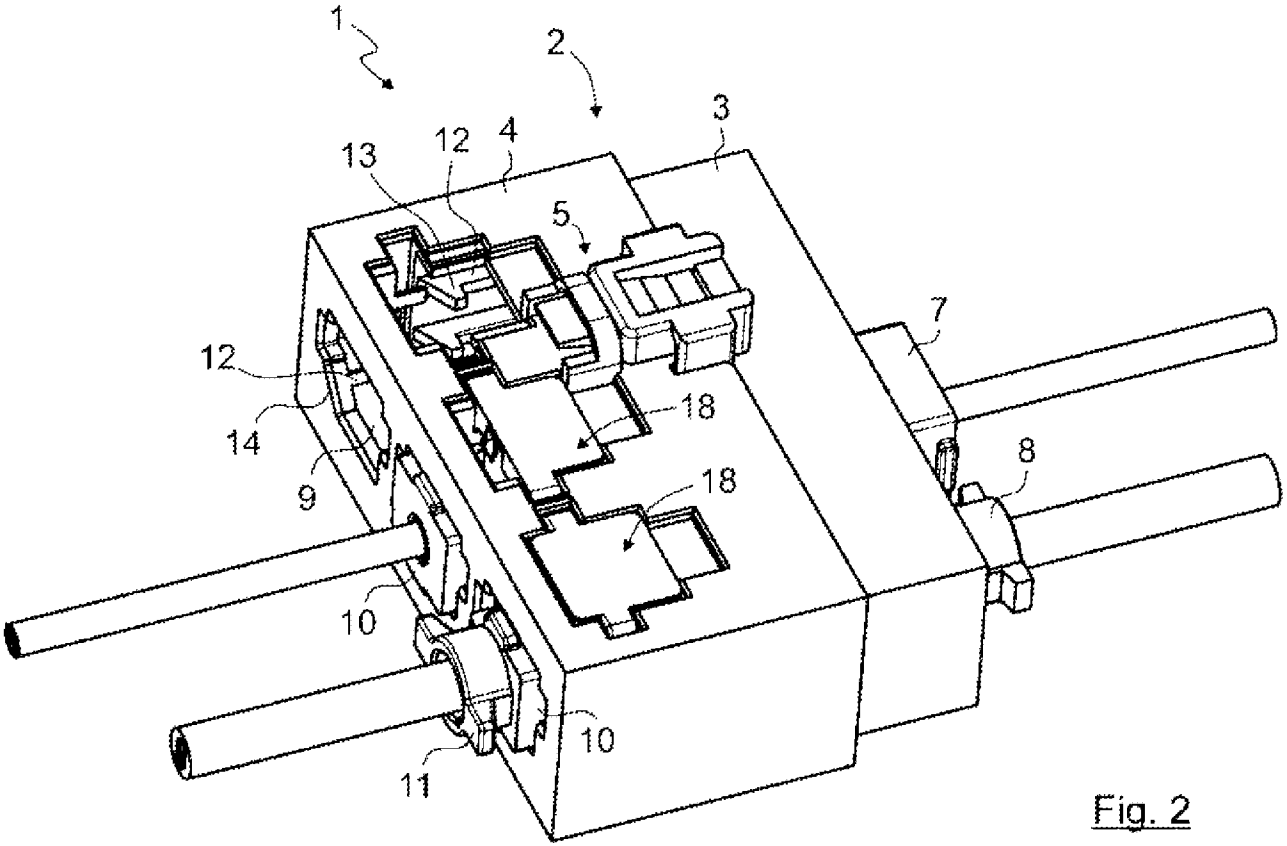
FIG. 2 schematically shows the modular plug connector system in the assembled state in an isometric view.

The exemplary embodiment shows the modular plug connector system 1 according to the invention for vehicles. FIG. 1 illustrates an unassembled state and FIG. 2 illustrates an assembled state.

The plug connector system 1 comprises a module housing 2 having a first housing part 3 and having a second housing part 4. The housing parts 3, 4 can be plugged one inside the other and can be latched with one another via a latching element pair 5 (cf. FIG. 2). In principle, however, the module housing 2 can also be formed in one piece. Furthermore, the latching element pair 5 can be formed at any desired point and in any desired embodiment, be multiply present or be omitted.

The first housing part 3 comprises a plurality of uniform plug places 6 with interfaces for respectively receiving a first adapter 7 from a first adapter group, wherein the first adapter group comprises a plurality of first adapters 7 of different type which have uniform interfaces on their outer sides for positioning, in particular for fastening, in the plug places 6 of the first housing part 3, and which have a different internal geometry for receiving differently configured plug connectors 8. Analogously, the second housing part 4 comprises a plurality of uniform plug places 9 with interfaces for respectively receiving a second adapter 10 from a second adapter group, wherein the second adapter group comprises a plurality of second adapters 10 of different type which have uniform interfaces on their outer sides for positioning, in particular for fastening, in the plug places 9 of the second housing part 4, and which have a different internal geometry for receiving differently configured mating plug connectors 11.

In principle, there can be provision for the housing parts 3, 4 to each have one (as realized in the exemplary embodiment), two, three or even more rows of plug places 6, 9 arranged parallel to or offset from one another. However, the exact number of plug places 6, 9 used and the arrangement or distribution thereof within the module housing 2 is of no importance for the purposes of the invention.

In the exemplary embodiment, the first housing part 3 can be connected to the second housing part 4 in order to connect the plug connectors 8 received in the first housing part 3 to the corresponding mating plug connectors 11 received in the second housing part 4. What is of essential importance here is the establishment of an electrical connection between the plug connectors 8 and the mating plug connectors 11.

Particularly if the module housing 2 is formed in one piece, there can also be provision that the first adapters 7, together with the plug connectors 8 received therein, can be plugged directly into the functionally defined first housing part 3 of the module housing 2 and are connected to the corresponding mating plug connectors 11 when the second adapters 10, together with the mating plug connectors 11 received therein, are plugged into the functionally defined second housing part 4 of the module housing 2.

The housing parts 3, 4 are preferably designed to securely channel away mechanical loads which act on the plug connectors 8 and the mating plug connectors 11 and/or to ensure the holding force between the plug connectors 8 and the mating plug connectors 11. It is accordingly the case that, inter alia, undesired shear forces are channeled away by the robust module housing 2, and the plug connectors 8 or the mating plug connectors 11 are less strongly loaded.

In principle, the plug connectors 8 and the mating plug connectors 11 can take the form of plugs, couplings, sockets, printed circuit board plug connectors and/or housing plug connectors. For example, plug connectors 8 or mating plug connectors 11 of the HFM, H-MTD, AMEC, PL, BNC, TNC, SMBA, SMA, SMB, SMS, SMC, SMP, BMS, HSD, BMK, Mini-Coax and/or Makax types can be used. The invention is not limited to a certain type of plug connector 8 or mating plug connector 11.

Figure 5:
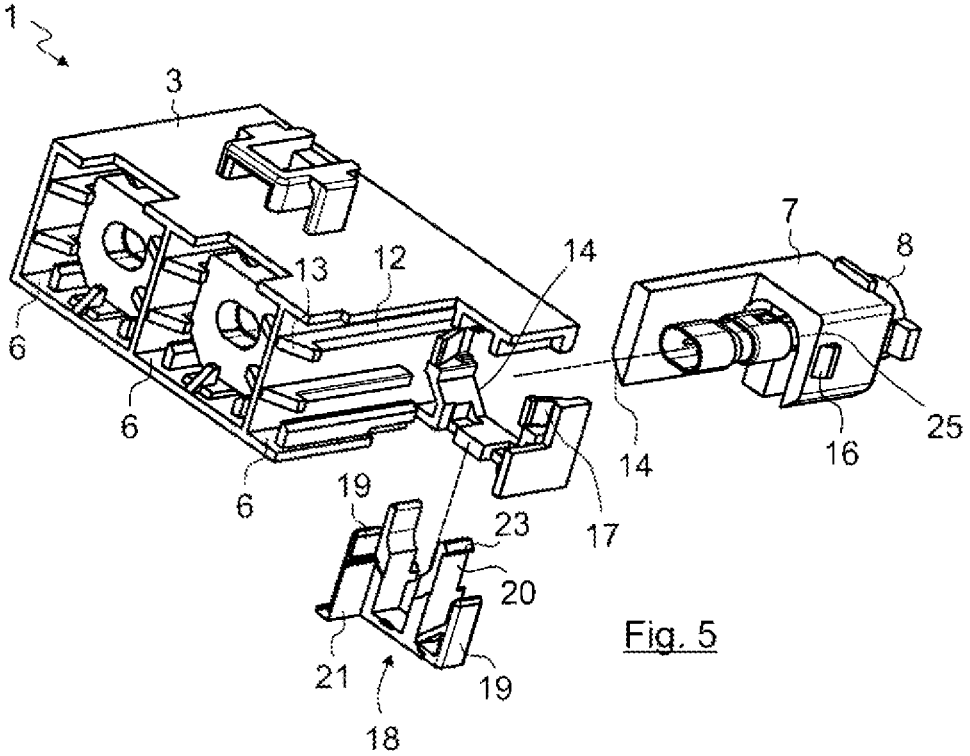
FIG. 5 schematically shows an isometric, partially sectioned view of the first housing part of the unassembled plug connector system.

In the exemplary embodiment, the plug places 6, 9 and the adapters 7, 10 form guides 12. In the exemplary embodiment, the guides take the form of guide webs 12 of the plug places 6, 9 and corresponding guide elements (not illustrated in further detail) of the adapters 7, 10. The guide webs 12 serve to receive the adapters 7, 10. Furthermore, the plug places 6, 9 comprise axial end stops 13 (cf. in particular FIG. 1 and FIGS. 5-6).

Figure 3:
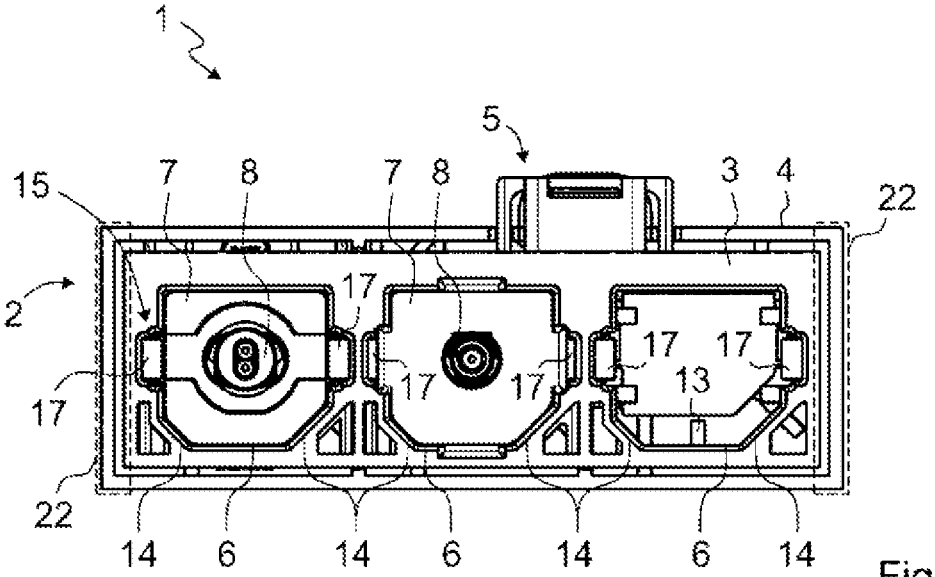
FIG. 3 schematically shows the assembled plug connector system of FIG. 2 in a front view of the first housing part.
Figure 4:
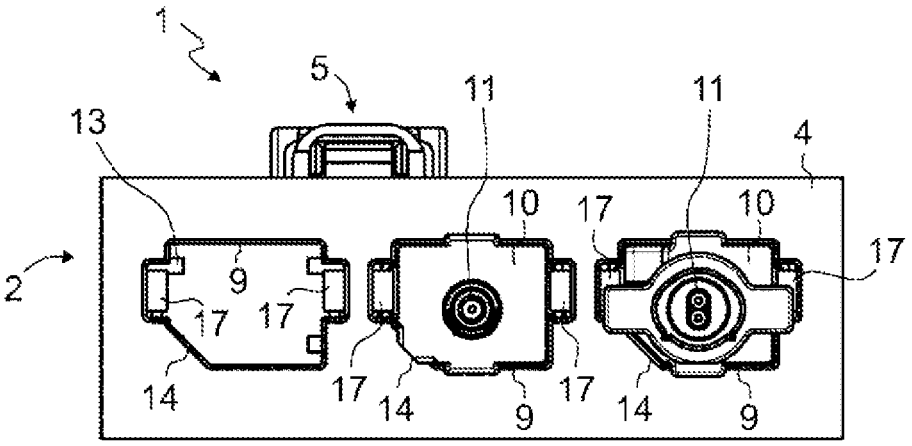
FIG. 4 schematically shows the assembled plug connector system of FIG. 2 in a front view of the second housing part.

It is furthermore possible for the adapters 7, 10 and the plug places 6, 9 to be configured in such a way that plugging-in of the adapters 7, 10 is possible in only one predetermined orientation. It is possible here particularly to avoid plugging-in with the wrong polarity, for example plugging-in with a rotation through 180°. The anti-rotational safeguarding is achieved in the exemplary embodiment by a mechanical coding which is realized by an asymmetrical geometrical configuration of the insertion openings in the plug places 6, 9 and by a corresponding external configuration of the adapters 7, 10. This can be seen in particular in FIGS. 3 and 4, which show a front view of the first housing part 3 (FIG. 3) and of the second housing part 4 (FIG. 4). The mechanical coding serving for this purpose is in particular in the form of differently configured bevels 14.

Furthermore, the first adapters 7, the second adapters 10 and the two housing parts 3, 4 are configured in such a way that the first adapters 7 can be plugged only into the plug places 6 of the first housing part 3, and the second adapters 10 can be plugged only into the plug places 9 of the second housing part 4. Also provided for this purpose is a corresponding mechanical coding which is realized by means of a corresponding geometrical configuration of the components using projections, recesses and/or bevels 14.

Furthermore, there can be provision that mechanical codings are provided on the end sides of the adapters 7, 10 that are at the front in the plug-in direction A, B (cf. FIG. 1) and/or on a front end of a plug place 6, 9 of the housing parts 3, 4 in such way that only pairs of plug connectors 8 and mating plug connectors 11 which are functionally assigned to one another can be connected.

Furthermore, there is provision in the exemplary embodiment that the outer sides of the first adapters 7 and the outer sides of the second adapters 10 and also the plug places 6 of the first housing part 3 and the plug places 9 of the second housing part 4 are configured in such a way that they form a primary securing means 15 (cf. FIGS. 6-9) for fastening the respective adapter 7, 10 in the corresponding plug place 6, 9 when the respective adapter 7, 10 is inserted into its end position in the corresponding plug place 6, 9.

Figure 6:
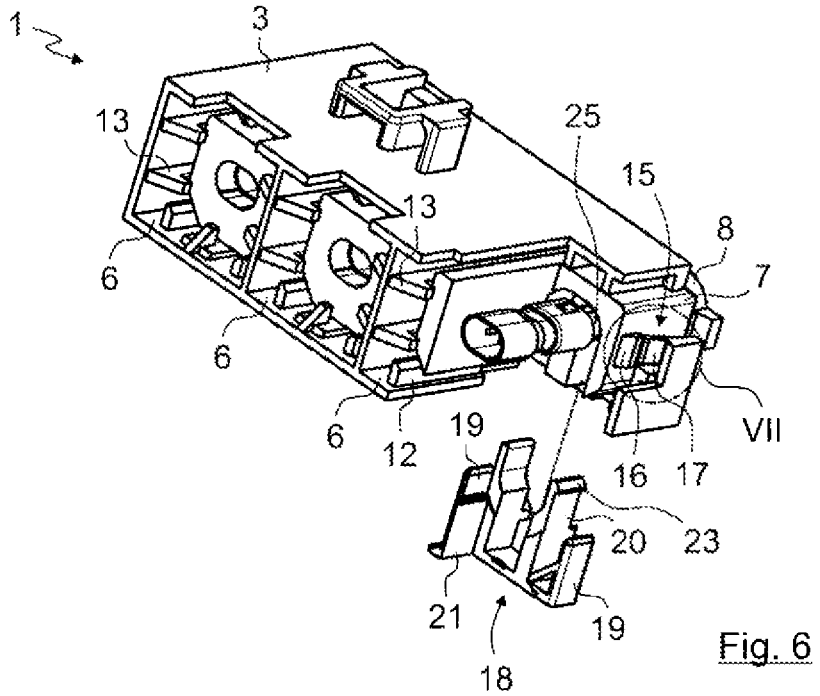
FIG. 6 schematically shows the illustration of the plug connector system as shown in FIG. 5 during a first assembly step.
Figure 7:
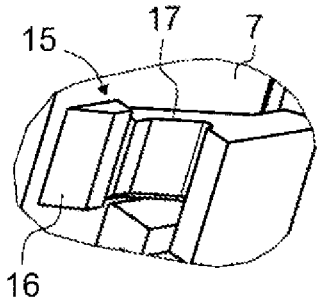
FIG. 7 schematically shows an enlarged illustration of the detail VII of FIG. 6.

In particular, there can be provision that the primary securing means 15 is formed by at least one latching nose 16 and a spring arm 17, as illustrated for example in FIG. 6 and the corresponding enlargement as shown in FIG. 7. The primary securing means preferably has two pairs of latching noses 16/spring arms 17 which fix the adapter 7, 10 on opposite sides in the respective plug place 6, 9.

In the exemplary embodiment, the plug connector system 1 further has secondary securing means 18 for securing the adapters 7, 10 in the respective plug places 6, 9 that can be plugged along a plug-in direction C orthogonally to the plug-in direction A, B of the adapters 7, 10 into the housing parts 3, 4 up and into a predefined end position. The end positions can be seen in particular in FIGS. 2 and 8 or 9.

Figure 8:
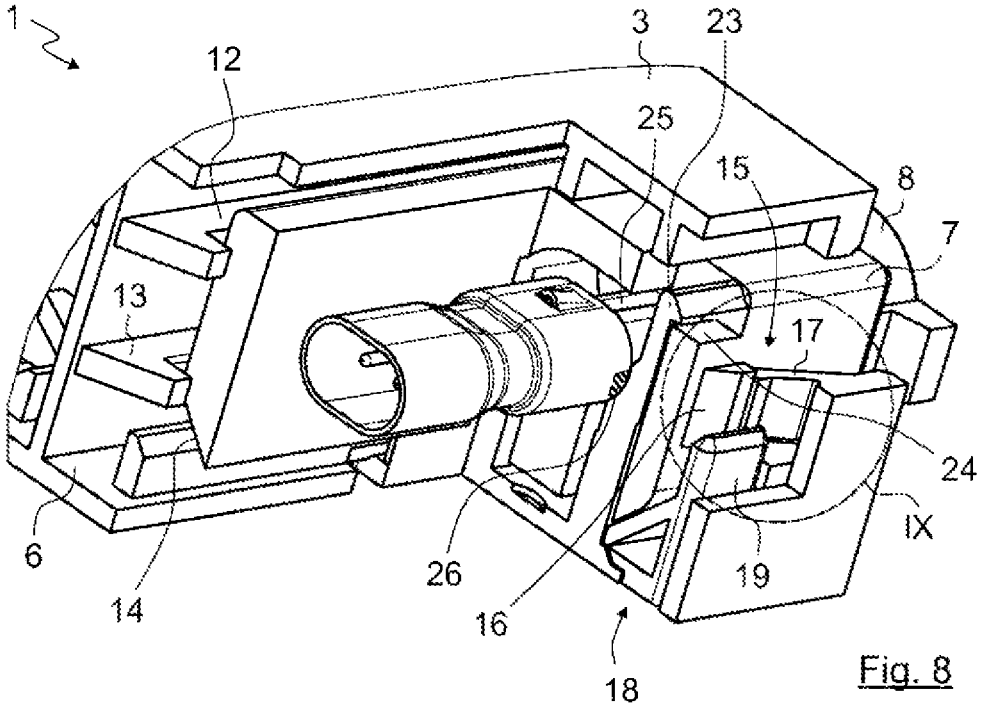
FIG. 8 schematically shows the enlarged-detail illustration of the plug connector system as shown in FIG. 5 during a second assembly step.
Figure 9:
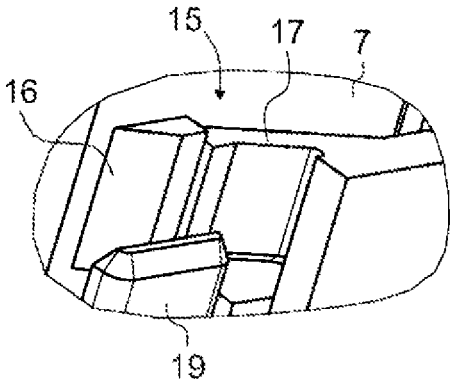
FIG. 9 schematically shows an enlarged illustration of the detail IX of FIG. 8.

In particular, the second secondary securing means 18 can have blocking elements 19 in order to block the primary securing means 15 in their locking state, for example by engaging behind the spring arms 17 in order to block them in the latching noses 16 in a form-fitting manner, as is clearly evident in FIG. 8 and the enlargement as shown in FIG. 9.

The blocking elements 19 prevent a situation in which the spring arms 17 can spring back into a position which releases the form fit (in the pull-out direction) between the latching nose 16 and the associated spring arm 17. The blocking elements 19 preferably take the form of flat plate-shaped or web-shaped projections whose front end engages behind the spring arms 17. Each secondary securing means preferably has two blocking elements 19 which, when the adapter 7, 10 is introduced into a plug place 6, 9, each secure a pair of the latching noses 16/spring arms 17.

Apart from securing the adapters 7, 10, the secondary securing means 18 can also be used for securing or for fastening the plug connectors 8 or the mating plug connectors 11 in the adapters 7, 10. There is preferably provided for this purpose a form-fitting and/or force-fitting connection between the secondary securing means 18 and the associated adapter 7, 10 on the one hand and a form-fitting and/or force-fitting connection between the secondary securing means 18 and the associated plug connector 8 or the mating plug connector 11. For this purpose, as illustrated in the exemplary embodiment, the secondary securing means 18 can have, for example, a securing clamp 20 which is inserted through an opening into the associated adapter 7, 10 and embraces in a form-fitting manner the plug connector 8 or the mating plug connector 11 received in the adapter 7, 10. Furthermore, the secondary securing means 18 can be configured in such a way that it is inserted into the associated adapter 7, 10 in a form-fitting manner.

Figure 10:
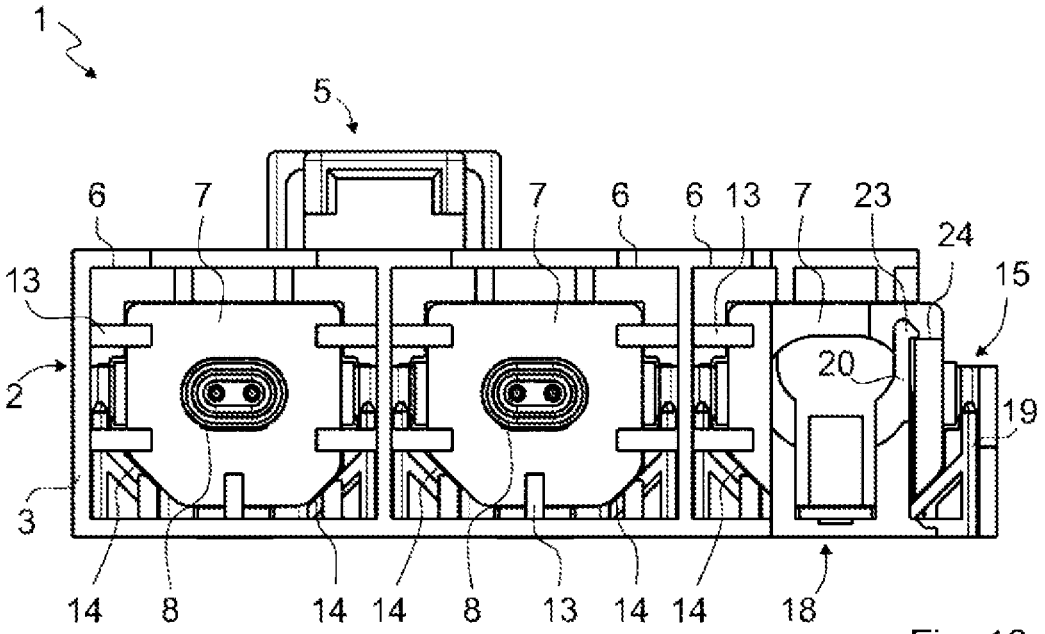
FIG. 10 schematically shows a front view of the first housing part with a partial section through one of the plug places to illustrate a secondary securing means in the end position in the plug place.

FIG. 8 and FIG. 10, in respect of which reference is made to the plug place 6 illustrated in section on the right in the drawing plane, illustrate a particularly advantageous embodiment for securing the secondary securing means 18 in the plugged-in end position. FIGS. 8 and 10 show a particularly advantageous end latching of the secondary securing means 18. The latching is preferably realized by virtue of the fact that the secondary securing means 18 has one, two or more latching elements 23. Preferably, only one latching element 23 is provided. The latching element 23 is preferably formed by virtue of the fact that the securing clamp 20 preferably has one, but possibly also more than one, snap hook 23.

The adapter 7, with which the secondary securing means 18 latches in the end position by means of the latching element, preferably the snap hook 23, has a corresponding latching receptacle 24. Here, the latching receptacle 24 can preferably take the form of a depression, groove or shoulder 24. The latching receptacle 24 is preferably formed in such a way that a form-fitting connection with the latching element 23 results in such a way that the form fit acts in the pull-out direction of the secondary securing means 18. This is correspondingly illustrated in FIG. 8 and FIG. 10.

If the secondary securing means 18 has more than one latching element 23, there is preferably also provided a corresponding number of latching receptacles 24.

Releasing of the snap hook 23 from the shoulder 24 can preferably be effected in the exemplary embodiment by virtue of the fact that a suitable tool, preferably a special tool, is inserted such that the form-fitting connection between the snap hook 23 and the shoulder 24 is released again.

As illustrated in FIG. 8 and FIG. 10, only one snap hook 23 is preferably formed on the securing clamp 20.

Although FIG. 10 shows the first housing part 3, the second housing part 4 or the second adapters 10 can be formed analogously.

The secondary securing means 18 is preferably configured in such a way that it can be plugged completely in its end position into the adapter 7, 10 only when both the adapter 7, 10 and the plug connector 8 or the mating plug connector 11 are situated in their predefined end position, that is to say in the assembly position. The secondary securing means 18 thus makes it possible to determine whether the adapters 7, 10 and the plug connectors 8 or the mating plug connectors 11 are correctly positioned. In the case of an incorrect position, the secondary securing means 18 cannot be plugged in up to its end position. This can preferably be achieved by the securing clamp 20 being configured in such a way that it can embrace the plug connector 8 or the mating plug connector 11 on the outside only when the securing clamp 20 strikes an outer region of the plug connector 8 or mating plug connector 11 that is suitably configured, preferably having a part-annular or annular depression, a groove, a recess, a taper 25 or a shoulder into which the securing clamp 20 can engage. This is illustrated in principle in FIGS. 5, 6 and 8.

The engagement preferably occurs in a form-fitting manner. With further preference, there is provision here, as can be seen in particular from FIG. 8, that a form fit results at least in the pull-out direction such that the plug connector 8 (or analogously the mating plug connector 11) is prevented from being pulled out. Where appropriate, in addition or alternatively to the end stop 13, there can also be provided a form fit in the plug-in direction of the plug connector 8 (or analogously of the mating plug connector 11). In the exemplary embodiment, the plug connector 8 has a shoulder such that a taper 25 results. Alternatively, a form fit can also be produced in and counter to the plug-in direction, for example by means of a groove. FIG. 8 illustrates a stop region 26 by way of example to symbolize the form fit.

It is preferable that for each adapter type of the two adapter groups there is provided a corresponding secondary securing means 18.

The secondary securing means 18, the housing parts 3, 4 and/or the adapters 7, 10 are preferably formed in such a way that the secondary securing means 18 can assume at least three plug states along their plug-in direction C, wherein a first plug state relates to a basic position in which the secondary securing means 18 is captively connected to the housing part 3, 4 but not yet connected to the corresponding adapter 7, 10, and wherein a second plug state relates to a pre-latching position in which the secondary securing means 18 is connected to the corresponding adapter 7, 10 inside the housing part 3, 4, and wherein a third plug state relates to the end position in which the secondary securing means 18 is completely plugged into the housing part 3, 4.

In a particularly advantageous manner, as can be seen in the Figs., the secondary securing means 18 channels axial forces acting on the plug connector 8/mating plug connector 11 into the associated housing part 3, 4. This is also achieved by the form-fitting connection of the secondary securing means 18 to the associated plug connector 8/mating plug connector 11 or the adapter 7, 10 and the form-fitting connection of the secondary securing means 18 to the associated housing part 3, 4.

As illustrated in the exemplary embodiment, the secondary securing means 18 can have plug-in preventers 21, wherein the plug-in preventers 21 can be designed to prevent two corresponding adapters 7, 10 from being plugged together when the secondary securing means 18 is not situated in its end position in the housing part 3, 4. The plug-in preventer 21 of the secondary securing means 18 preferably blocks the plugging together of the corresponding adapters 7, 10 of the plug connector 8 with a mating plug connector 11 when the secondary securing means 18 is situated in its pre-latching position.

The plug-in preventer 21 can be designed in such a way that, during the plugging-in of the secondary securing means 18, it is situated first of all in the displacement path of the adapter 10, 7 corresponding to the adapter 7, 10 assigned to the secondary securing means 18 and frees up the displacement path only in the completely plugged end state.

The interfaces, which are configured uniformly for the adapters 7, 10, are configured in such way that they form at least one, preferably a plurality of, particularly preferably all, the interface(s) stated as follows: an interface for the primary securing means, for example the latching noses 16; an interface for the secondary securing means 18; an interface for guiding, for example a corresponding guide which interacts with the guide webs 12; an interface for the end stops 13; and an interface for positioning the adapters 7, 10 in as play-free a manner as possible in the plug places 6, 9 in the end position, for which purpose the adapters 7, 10 preferably have a suitable external geometry.

Finally, there can be provision for the module housing 2 or its housing parts 3, 4 to be mechanically coded such that only housing parts 3, 4 of a common module housing type can be plugged one inside the other. Purely by way of example, a region 22 in which corresponding mechanical codings can be provided on the first housing part 3 is highlighted in FIG. 3 using dashed lines.

In the exemplary embodiment, the invention is illustrated in the preferred variant in which the adapter 7 and the adapter 10 are formed in such a way that they have an internal geometry for receiving differently configured plug connectors 8 or mating plug connectors 11. However, it is also possible, in a manner which has not been illustrated, to provide for the adapter 7 to be formed in one piece with differently configured plug connectors 8. Alternatively or additionally, there can moreover be provision for the adapters 10 also to be formed in one piece with differently configured mating plug connectors 11. Also possible here are mixed forms between the two alternatives, that is to say there can be provision for some of the plug connectors 8 or some of the mating plug connectors 11 to be received by a corresponding adapter 7, 10, whereas other adapters 7, 10 are formed in one piece with a plug connector 8 or a mating plug connector 11. It is also possible for the adapters 10 to be formed in one piece with the mating plug connectors 11, whereas the adapters 7 have an internal geometry for receiving differently configured plug connectors 8, and vice versa.

While the invention has been described with reference to various preferred embodiments, it should be understood by those skilled in the art that various changes may be made and equivalents substituted for elements thereof without departing from the scope of the invention. In addition, many modifications may be made to adapt to a particular situation or application of the invention without departing from the scope of the invention. Therefore, it is intended that the invention not be limited to the particular embodiments disclosed but rather, that the invention will include all embodiments falling within the scope of the appended claims, either literally or under the Doctrine of Equivalents.

What is claimed is:

1. A modular plug connector system, said system comprising:

a module housing having a first housing part and a second housing part, the first housing part and the second housing part being two separate housing parts which are connectable to one another; the first housing part having a plurality of uniform first plug places for receiving a respective first adapter of a first adapter group; the first adapter group including a plurality of first adapters for positioning in the first plug places of the first housing part, each of the first adapters having outer sides with first interfaces which are uniform among the first adapters in the first adapter group; the first adapters each having a respective first internal geometry; the first internal geometry differing among the first adapters in the first adapter group for receiving respectively differently configured first plug connectors; the first adapters and the first plug connectors being separate components which can be plugged together with one another; the outer sides of the first adapters and the first plug places of the first housing part being configured to form a first primary securing means for fastening a respective one of the first adapters in a respective one of the first plug places when the respective one of the first adapters is inserted into a first end position in the respective one of the first plug places; the second housing part having a plurality of uniform second plug places, each of the second plug places receiving a respective second adapter of a second adapter group; the second adapter group including a plurality of second adapters for positioning in the second plug places of the second housing part, each of the second adapters having outer sides with second interfaces which are uniform among the second adapters in the second adapter group; the second adapters each having a respective second internal geometry; the second internal geometry differing among the second adapters in the second adapter group for receiving respectively differently configured second plug connectors; the second adapters and the second plug connectors being separate components which can be plugged together with one another; the outer sides of the second adapters and the second plug places of the second housing part being configured to form a second primary securing means for fastening one of the second adapters in a respective one of the second plug places when the second adapter is inserted into a second end position in the respective one of the second plug places; the first housing part and second housing part being connectable to one another such that when the first housing part and second housing part are connected to one another, each one of the first plug connectors received in the first housing part is connected to a corresponding one of the second plug connectors received in the second housing part; the first adapters, the second adapters, the first housing part and the second housing part being configured such that the first adapters can be plugged only into the first plug places of the first housing part and the second adapters can be plugged only into the second plug places of the second housing part.

2. The plug connector system as claimed in claim 1, wherein the module housing further includes at least one latching element pair and wherein the first housing part can be plugged into the second housing part and wherein the first housing part and the second housing part can be latched with one another via the at least one latching element pair.

3. The plug connector system as claimed in claim 1, wherein the first plug connectors and the second plug connectors are designed as at least one of: plugs, couplings, sockets, printed circuit board plug connectors and housing plug connectors.

4. The plug connector system as claimed in claim 3, wherein the first plug connectors and the second plug connectors are designed as housing plug connectors of at least one of the following types: HFM, H-MTD, AMEC, PL, BNC, TNC, SMBA, SMA, SMB, SMS, SMC, SMP, BMS, HSD, BMK, Mini-Coax and Makax.

5. The plug connector system as claimed in claim 1, wherein the first housing part has two or more rows of the first plug places, the rows of first plug places being arranged parallel to one another and wherein the second housing part has two or more rows of the second plug places, the rows of the second plug places being arranged parallel to one another.

6. The plug connector system as claimed in claim 1, wherein at least one of the first plug places and at least a corresponding one of the first adapters form a guide for guiding the first adapters into the first plug places.

7. The plug connector system as claimed in claim 1, wherein the first plug places have an axial end stop.

8. The plug connector system as claimed in claim 1, wherein the first primary securing means is formed by at least one latching nose and a spring arm.

9. The plug connector system as claimed in claim 1, wherein the first adapters and the first plug places are configured in such a way that plugging-in of the first adapters is possible in only a single predetermined orientation.

10. The plug connector system as claimed in claim 1, wherein the first adapters are provided with mechanical codings in such a way that only pairs of first plug connectors and second plug connectors which are functionally assigned to one another can be connected to one another.

11. The plug connector system as claimed in claim 1, wherein a corresponding secondary securing means is provided for each adapter type of the first adapter group and for each adapter type of the second adapter.

12. The plug connector system as claimed in claim 1, wherein the first adapters are formed in one piece with the first plug connectors.

13. The plug connector system as claimed in claim 12, wherein the second adapters are formed in one piece with the second plug connectors.

14. The plug connector system as claimed in claim 1, wherein the first housing part has two or more rows of the first plug places, the rows of first plug places being arranged offset from one another and wherein the second housing part has two or more rows of the second plug places, the rows of second plug places being arranged offset from one another.

15. The plug connector system as claimed in claim 1, wherein at least one of the second plug places and at least a corresponding one of the second adapters form a guide for guiding the second adapters into the second plug places.

16. The plug connector system as claimed in claim 1, wherein the second plug places have an axial end stop.

17. The plug connector system as claimed in claim 1, wherein the first adapters and the second plug places are configured in such a way that plugging-in of the second adapters is possible in only a single predetermined orientation.

18. A modular plug connector system, said system comprising:

a module housing having a first housing part and a second housing part, the first housing part and the second housing part being connectable to one another, the first housing part having a plurality of uniform first plug places, each of the first plug places having a respective interface for receiving a respective first adapter of a first adapter group, the first adapter group including a plurality of first adapters for positioning in the first plug places of the first housing part, each of the first adapters having outer sides with first interfaces which are uniform among the first adapters in the first adapter group, each of the first adapters having a respective internal geometry which differs among the first adapters in the first adapter group for receiving respectively differently configured first plug connectors, the outer sides of the first adapters and the first plug places of the first housing part being configured to form a first primary securing means for fastening a respective one of the first adapters in a respective one of the first plug places when the first adapter is inserted into a first end position in the respective one of the first plug places, the second housing part having a plurality of uniform second plug places receiving a respective second adapter of a second adapter group, the second adapter group including a plurality of second adapters for positioning in the second plug places of the second housing part, each of the second adapters having outer sides with second interfaces which are uniform among the second adapters in the second adapter group, each of the second adapters having a respective internal geometry which differs among the second adapters in the second adapter group and which have a different internal geometry for receiving respectively differently configured second plug connectors, the outer sides of the second adapters and the second plug places of the second housing part being configured to form a second primary securing means for fastening the second adapter in the respective second plug place when the second adapter is inserted into a second end position in the second plug place; said system further comprising secondary securing means for securing the first adapter in the respective one of the first plug places by inserting the secondary securing means into the first housing part in an orthogonal direction to a predefined end position at which the secondary securing means is completely plugged into the first housing part, the orthogonal direction being orthogonal to a plug-in direction, the plug-in direction being a direction in which the first adapter plugs into the first housing part.

19. The modular plug connector system as claimed in claim 18, wherein the secondary securing means have blocking elements which block the first primary securing means in a locking state.

20. The modular plug connector system as claimed in claim 18, wherein the secondary securing means have plug-in preventers which prevent a connection between the plug first connector and a corresponding one of the second plug connectors when the secondary securing means is plugged into the first housing part but is not yet in the predefined end position.

21. The modular plug connector system as claimed in claim 18, wherein the secondary securing means secure the first plug connectors in the first adapters.

22. The modular plug connector system as claimed in claim 18, wherein the secondary securing means assumes at least three plug states, the at least three plug states including: (i) a first plug state in which the secondary securing means is at a basic position at which the secondary securing means is captively connected to the first housing part but not yet connected to the corresponding first adapter, and (ii) a second plug state in which the secondary securing means is at a pre-latching position and is connected to the corresponding first adapter inside the first housing part, and (iii) a third plug state in which the secondary securing means is at the predefined end position and fixes the first plug connector in the corresponding first adapter.

23. The modular plug connector system as claimed in claim 18, wherein the secondary securing means in the end position is connected to the first housing part in a form-fitting manner and to the first adapter in a form-fitting manner in order to channel axial forces acting on the first plug connectors via the secondary securing means into the first housing part.

24. The modular plug connector system as claimed in claim 18, wherein the secondary securing means secure the first plug connectors to the second adapters.

25. The modular plug connector system as claimed in claim 18, wherein the secondary securing means assumes at least three plug states, the at least three plug states including: (i) a first plug state in which the secondary securing means is at a basic position at which the secondary securing means is captively connected to the second housing part but not yet to a corresponding second adapter, and (ii) a second plug state in which the secondary securing means is at a pre-latching position and is connected to the corresponding second adapter inside the second housing part, and (iii) a third plug state in which the secondary securing means is at the predefined end position and fixes the second plug connector in the corresponding second adapter.

26. A module housing for a modular plug connector system, said module housing comprising:

a first housing part and a second housing part, the first housing part and the second housing part being two separate housing parts which are connectable to one another, the first housing part having a plurality of uniform first plug places for receiving a respective first adapter of a first adapter group, the first adapter group including a plurality of first adapters for positioning in the first plug places of the first housing part, each of the first adapters having outer sides with first interfaces which are uniform among the first adapters in the first adapter group; the first adapters each having a respective first internal geometry; the first internal geometry differing among the first adapters in the first adapter group for receiving respectively differently configured first plug connectors; the first adapters and the first plug connectors being separate components which can be plugged together with one another; the outer sides of the first adapters and the first plug places of the first housing part being configured to form a first primary securing means for fastening a respective one of the first adapters in a respective one of the first plug places when the respective one of the first adapters is inserted into a first end position in the respective one of the first plug places; the second housing part having a plurality of uniform second plug places, each of the second plug places receiving a respective second adapter of a second adapter group, the second adapter group including a plurality of second adapters for positioning in the second plug places of the second housing part, each of the second adapters having outer sides with second interfaces which are uniform among the second adapters in the second adapter group; the second adapters each having a respective second internal geometry; the second internal geometry differing among the second adapters in the second adapter group for receiving respectively differently configured second plug connectors; the second adapters and the second plug connectors being separate components which can be plugged together with one another; the outer sides of the second adapters and the second plug places of the second housing part forming a second primary securing means for fastening one of the second adapters in a respective one of the second plug places when the second adapter is inserted into a second end position in the respective one of the second plug places; the first housing part and second housing part being connectable to one another such that when the first housing part and second housing part are connected to one another, each one of the first plug connectors received in the first housing part is connected to a corresponding one of the second plug connectors received in the second housing part; the first adapters, the second adapters, the first housing part and the second housing part being configured such that the first adapters can be plugged only into the first plug places of the first housing part and the second adapters can be plugged only into the second plug places of the second housing part.

* * * * *